US005560659A

United States Patent [19]

Dault

[11] Patent Number: 5,560,659

[45] Date of Patent: Oct. 1, 1996

[54] DOOR HANDLE ASSEMBLY

[75] Inventor: Robert Dault, Perrysburg, Mich.

[73] Assignee: ADAC Plastics, Inc., Grand Rapids, Mich.

[21] Appl. No.: 334,042

[22] Filed: Nov. 4, 1994

[51] Int. Cl.[6] ..... E05B 3/00

[52] U.S. Cl. ..... 292/336.3; 292/337

[58] Field of Search ..... 292/347, 337, 292/336.3, DIG. 31, DIG. 53, DIG. 64

[56] References Cited

U.S. PATENT DOCUMENTS

| | | | |
|---|---|---|---|
| 4,588,219 | 5/1986 | Kobayashi et al. | 292/DIG. 31 X |
| 4,796,934 | 1/1989 | Kesel et al. | 292/336.3 |
| 5,007,668 | 4/1991 | Di Giusto | 292/DIG. 53 X |
| 5,092,642 | 3/1992 | Lindmayer et al. | 292/DIG. 73 X |

FOREIGN PATENT DOCUMENTS

| | | | |
|---|---|---|---|
| 632123 | 11/1949 | United Kingdom | 292/336.3 |
| 1120527 | 7/1968 | United Kingdom | 292/336.3 |

*Primary Examiner*—Steven N. Meyers
*Assistant Examiner*—Monica E. Millner
*Attorney, Agent, or Firm*—Young & Basile, P.C.

[57] ABSTRACT

A door handle assembly for a motor vehicle which acts to preclude inadvertent unlatching of the door in response to a side impact. The door handle assembly includes a handle and a blocking member both pivotally mounted in an escutcheon and each including an actuator portion positioned in the window of the escutcheon and a stop portion positioned within the cavity of the escutcheon. The stop portions positioned within the cavity coact in the event of side impact to preclude inadvertent inertial pivotal movement of the handle to an unlatched position but depression of the blocking member actuator portion moves the stop portion of the blocking member out of the path of movement of the stop portion of the handle to allow the handle to be moved to open the door.

13 Claims, 4 Drawing Sheets

46
26d
10
30e
54
50
56
42
26a
52
48
58
44
26

DOOR HANDLE ASSEMBLY

BACKGROUND OF THE INVENTION

This invention relates to handle assemblies and more particularly to handle assemblies for controlling the latch mechanisms on vehicle doors.

Vehicle doors typically include a latch mechanism for latching and unlatching the door to the vehicle body, a handle assembly positioned on the door and operative to control the latch mechanism, and a lock mechanism to selectively render the handle assembly effective or ineffective to operate the latch. It is imperative that side impact against the vehicle, resulting for example from a collision, not result in the inadvertent movement of the handle of the handle assembly to a latch release position with consequent movement of the latch to an unlatched position and consequent inadvertent opening of the door. This in general is not a problem when the door is locked since in this case the door handle is either precluded from movement by the lock mechanism or the door handle is allowed to freewheel to its unlatched position but this movement is ineffective to move the latch to its unlatched position. However, when the door is unlocked, as is most typically the case in an operating vehicle, side impact can easily result in inertial movement of the door handle to its unlatched position with consequent unlatching of the latch mechanism, consequent opening of the door, and consequent discharge of unbuckled vehicle passengers from the vehicle.

SUMMARY OF THE INVENTION

This invention is directed to the provision of an improved door handle assembly for use with a vehicular door.

More specifically, this invention is directed to the provision of a vehicular door handle assembly that operates to preclude inadvertent opening of the door in the event of a side impact against the vehicle.

The invention door handle assembly is intended for use with a vehicle including a door and a latch assembly mounted on the door and controlled by the door handle assembly. The door handle assembly in known manner includes a door handle adapted to be grasped by an operator and mounted proximate an exterior surface of the door for movement between a latched position in which the latch assembly maintains the door in a latched condition and an unlatched position in which the latch assembly is moved to an unlatched condition.

According to the invention, the door handle includes a stop portion; the door handle assembly further includes a blocking member including a stop portion; and the blocking member is mounted proximate the door handle for movement under control of the operator between a blocking position in which the blocking member stop portion is positioned in the path of movement of the door handle stop portion to preclude movement of the door handle to its unlatched position, and a release position in which the blocking member stop portion is moved out of the path of movement of the door handle stop portion to allow movement of the door handle to its unlatched position. This arrangement allows the blocking member to preclude inadvertent movement of the door handle to an unlatched position and allows the blocking member to be readily moved out of the way by the operator to allow movement of the door handle to its unlatched position.

According to a further feature of the invention, the door assembly further includes a housing mounted in the outer skin of the door and defining a cavity in the door and an opening into the cavity, and the handle and the blocking member are mounted in the cavity for pivotal movement about parallel axes. This arrangement provides convenient and efficient packaging of the door handle assembly.

According to a further feature of the invention, the pivot axes of the handle and the blocking member are generally horizontal and the handle and blocking member include actuator portions which coact with the handle in its latched position and the blocking member in its blocking position to substantially close off the cavity opening. This specific packaging provides a pleasing appearance and discourages the entry of debris into the housing cavity.

According to a further feature of the invention, the handle actuator portion is positioned in an upper portion of the cavity opening and the blocking member actuator portion is positioned in a lower portion of the cavity opening. This specific relative positioning of the handle and blocking member actuator portions facilitates the operation of the door handle assembly.

According to a further feature of the invention, the handle actuator portion pivots forwardly out of the cavity as the handle moves from its latched to its unlatched position and the blocking member actuator portion pivots rearwardly into the cavity as the blocking member moves from its blocking to its release position. This specific arrangement allows the operator to push the blocking member actuator portion rearwardly into the cavity to release the door handle and thereafter pull the door handle actuator portion forwardly to unlatch the door.

In a disclosed embodiment of the invention, the blocking member is pivotally mounted on a lower region of the housing for pivotal movement between its blocking position, in which the actuator portion is positioned in the cavity opening below the handle actuator portion and the stop portion is positioned behind the handle actuator portion in the path of movement of the handle stop portion, and its release position, in which the blocking member is pivoted rearwardly within the cavity to move the blocking member stop portion out of the path of movement of the handle stop portion. This specific relative packaging as between the handle and the blocking member facilitates the effective preclusion of inadvertent unlatching movement of the handle while yet allowing ready movement of the blocking member to a position allowing deliberate unlatching movement of the handle.

DETAILED DESCRIPTION OF THE PREFERRED EMBODIMENT

Figure 1:
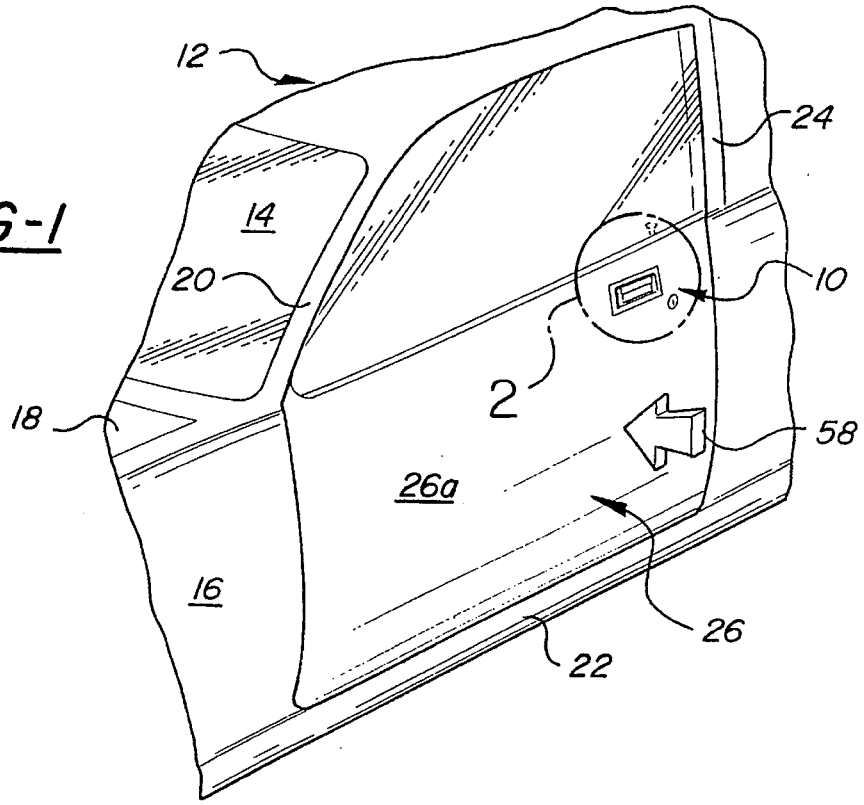
FIG. 1 is a fragmentary perspective view of a motor vehicle including a door embodying the door handle assembly of the invention.

The invention door handle assembly 10 is seen in FIG. 1 in association with a fragmentarily shown motor vehicle 12 including a windshield 14, a front quarter panel 16, a hood 18, an A pillar 20, a sill 22, a B pillar 24, and a door 26 positioned in the door opening defined by the A pillar 20, front quarter panel 16, sill 22 and B pillar 24.

Door handle assembly 10, broadly considered, includes an escutcheon or housing 28, a handle 30, and a blocking member 32. Members 28, 30 and 32 are formed of a suitable ferrous or other rigid material and may be formed for example in a stamping or a molding operation.

Escutcheon 28 has a generally boxlike configuration and includes a top wall 28*a*, a bottom wall 28*b*, side walls 28*c* and an angled rear wall 28*d*. Walls 28*a*, 28*c*, 28*b* and 28*c* coact to define a forward opening or window 34 bounded by a peripheral flange portion 28*e* of the escutcheon. Escutcheon 28 further includes a pair of spaced upper lugs 28*f*, spaced upper slots 28*g* associated with respective lugs 28*f*, a pair of spaced lower lugs 28*h*, and spaced lower slots 28*i* associated with respective lugs 28*h*. The housing walls further coact to define a housing cavity 28*j*.

Handle 30 includes a generally flat blade or actuator portion 30*a* and a pair of curvilinear arms 30*b*. Each arm includes a pivot portion 30*c* and a stop portion 30*d*. One or both arms 30*b* further includes a crank portion 30*e*, and handle blade portion 30*a* includes a free end edge portion 30*f* extending rearwardly with respect to the main body of the blade portion.

Blocking member 32 includes a generally planar blade or actuator portion 32*a*, a pair of lower arm portions 32*b*, and an upper arcuate stop portion 32*c* terminating in a stop edge 32*d* and separated from blade portion 32*a* by a groove 32*e* sized to seat the free end edge portion 30*f* of the blade portion of the handle.

Figure 3:
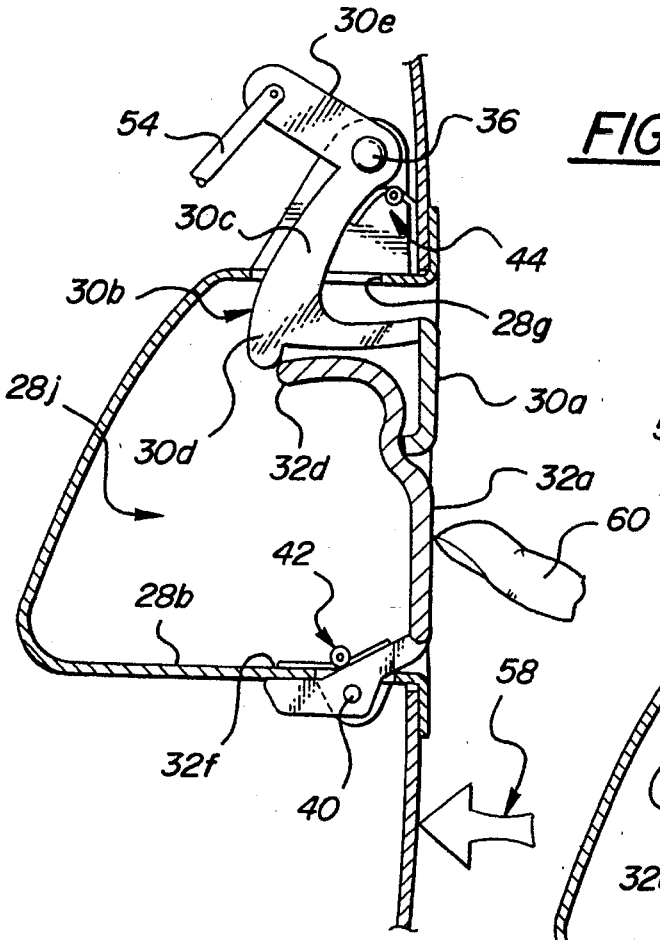
FIG. 3 is a cross-sectional view taken on line 3—3 of FIG. 2.

In the assembled relation of the door handle assembly, handle arm portions 30*b* extend upwardly through respective housing slots 28*g* to position stop portions 30*d* within housing cavity 28*j* and position handle actuator portion 30*a* in the upper region of the window or opening 34; a pin or shaft 36 extends through aligned apertures in handle pivot portions 30*c* and in upper lugs 28*f* to pivotally mount the handle with respect to the housing; pivot arms 32*b* extend downwardly through respective housing slots 28; to position blade or actuator portion 32*a* in the lower region of window 34 beneath the handle actuator portion with free end edge portion 30*f* of the handle seated in blocking member groove 32*e* and with blocking member stop portion 32*c* positioned in cavity 28*j* behind handle actuator portion 30*a* with the leading edge 32*d* of the stop portion positioned proximate and in the path of stop portions 30*d* of handle pivot arms 30*b*; and a pivot pin or shaft 40 passes through aligned apertures in blocking member pivot arms 32*b* and in lower housing lugs 28*h* to pivotally mount the lower end of the blocking member on the housing. A spring 42 (shown schematically) serves to bias the blocking member toward a blocking position (as seen in FIG. 3) with the extent of clockwise pivotal movement of the blocking member as viewed in FIG. 3 delimited and defined by engagement of the upper faces 32*f* of pivot arms 32*b* with the underface of housing bottom wall 28*b*. Spring 42 further acts to resiliently resist clockwise pivotal movement of the blocking member from the blocking position seen in FIG. 3 toward the release positions seen in FIG. 4. A further spring 44 (shown schematically) acts to bias the handle for clockwise movement about the axis of pin 36 to position the handle actuator portion 30*a* in the window 34 above the blocking member actuator portion with the extent of clockwise movement of the handle defined and delimited by engagement of the pivot arms 30*b* of the handle with the rear edges of slots 28*g*. Spring 44 also serves to resiliently resist pivotal movement of the handle from the latched position seen in FIGS. 3 and 4 toward the unlatched position seen in FIG. 5.

Figure 2:
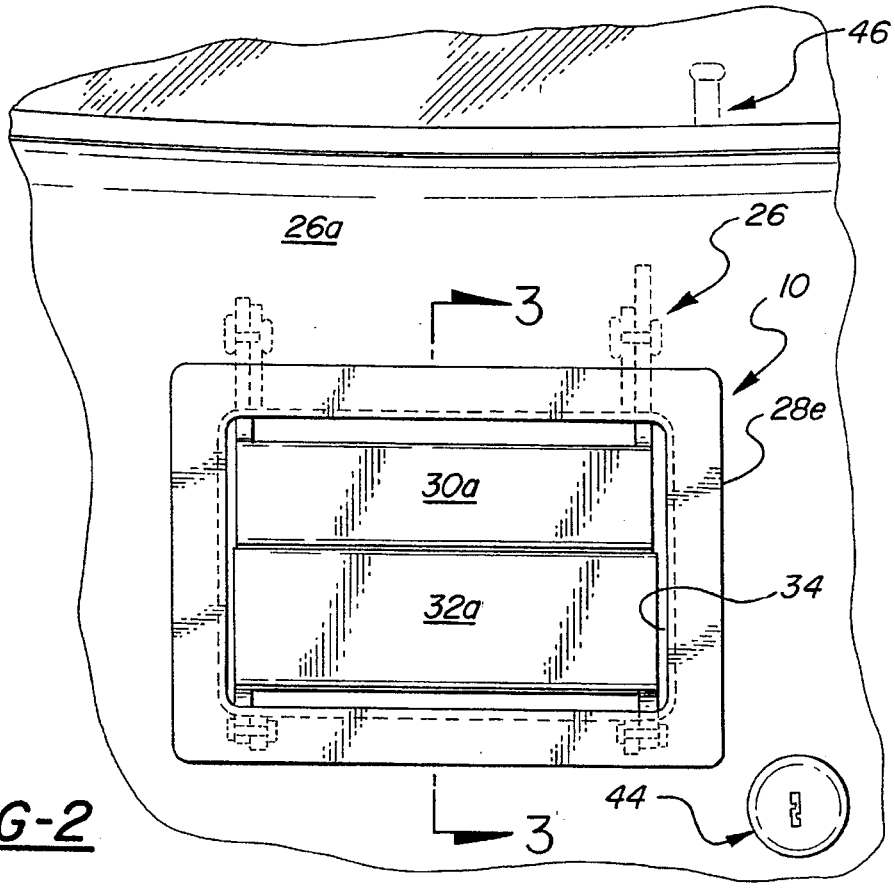
FIG. 2 is a detail view taken within the circle 2 of FIG. 1.

As best seen in FIG. 2, handle 30, in its latched position, coacts with blocking member 32, in its blocking position, to substantially close off the cavity opening or window 34. Door handle assembly 10 is suitably positioned in the outer skin 26*a* of door 26 by positioning the escutcheon in an opening 26*b* in the outer skin and suitably securing the flange 28*e* of the escutcheon to the outer skin. This positions the escutcheon cavity 28*j* rearwardly of the outer skin and within the door and positions the escutcheon window 34 generally flush with the door outer skin.

Figure 7:
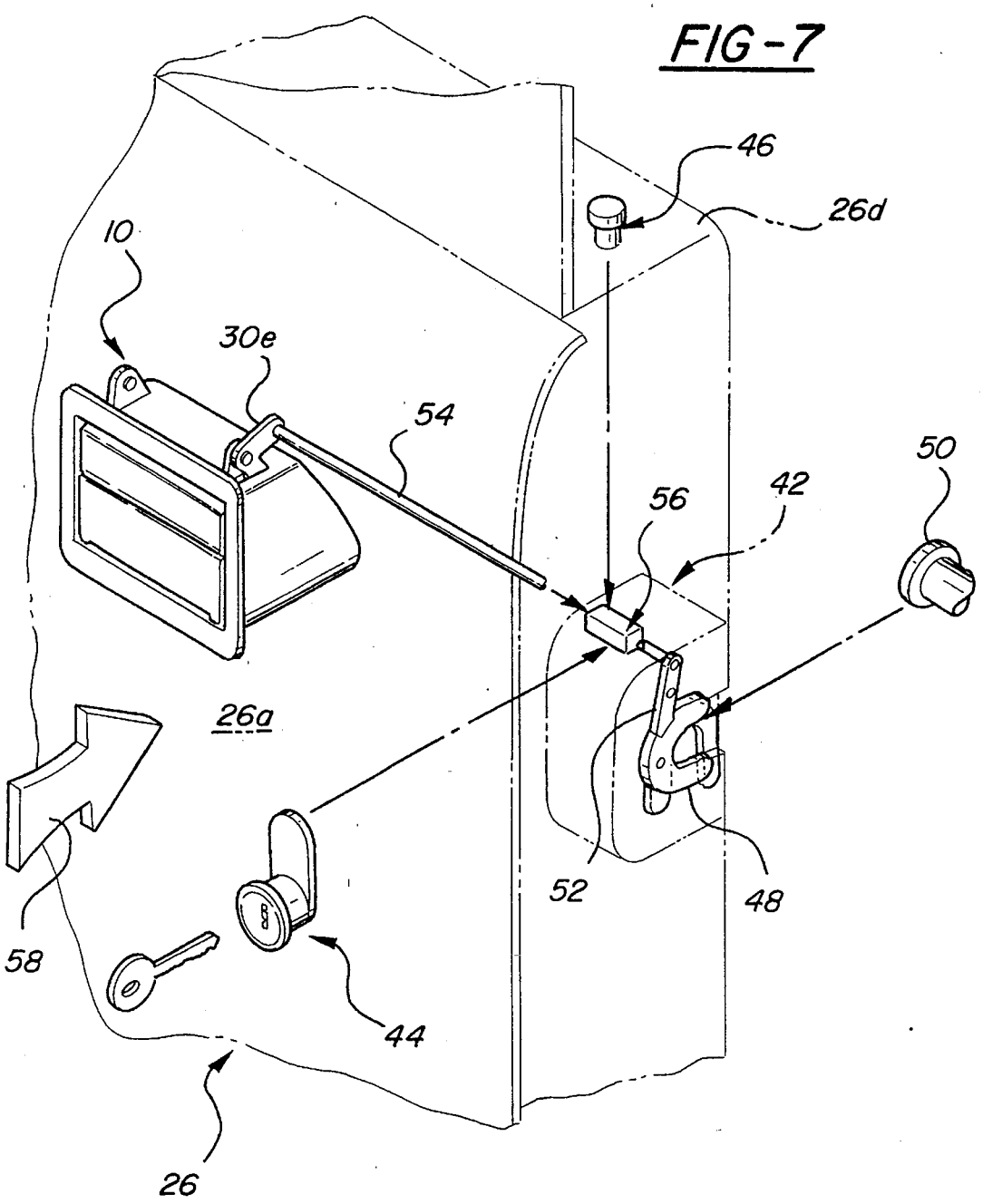
FIG. 7 is a perspective, fragmentary, somewhat schematic view of the invention door handle assembly incorporated in a vehicular door assembly.

As best seen in FIG. 7, door handle assembly 10 is intended for use with a vehicular door assembly including door 26, a latch assembly 42 positioned on the shut face 26*c* of the door, a key cylinder lock 44 positioned in the outer skin 26*a* of the door proximate door handle assembly 10, and a push button lock 46 positioned on the top sill 26*d* of door 26 in overlying relation to latch assembly 42 and coupled for joint operation with key cylinder lock 44. Latch assembly 42 is of known form and includes a latch member 48 coacting with a bolt 50 on the confronting face of the vehicular structure to pivotally move the latch member 48 between its illustrated solid line unlatched position and its dotted line latched position. Latch assembly 42 further includes a dog 52 coacting with a detent on latch member 48 to maintain the latch member in its latched condition against the bias of a spring (not shown) and operative when released to allow the latch member to return under the bias of the spring to the unlatched position and thereby move the door to an unlatched position. Dog 50 is controlled in known manner by a link or rod 54 secured to crank arm 30*e*. Specifically, pivotal movement of crank arm 30*e* with key cylinder 44 and push button 46 in an unlocked condition has the effect of releasing the latch member 48 for movement to an unlatched position. However, latch assembly 42, in known manner, further includes a decoupling mechanism 56 (shown schematically) which serves to render the rod 54 ineffective to release the latch member 48 when the push button 46 and lock cylinder 44 are in a locked condition.

In the operation of the invention door handle assembly, with particular reference to FIGS. 3, 4, 5 and 6, it will be seen that the stop portion 32*c* of the blocking member 32, and specifically the leading edge 32*d* of the stop portion, is normally positioned in the path of pivotal movement of the stop portions 30*d* of the pivot arms 30*b* of the handle with the handle in its latched position and the blocking member in its blocking position so that, in the event of a side impact against the vehicle, as schematically represented by the arrow 58, the handle 30 will be precluded from any significant rotational movement of the handle about the axis of the pin 36 in response to the impact 58 by the immediate engagement of edge 32*d* with stop portions 30*d*, thereby precluding inadvertent inertial movement of the handle to its unlatched position with consequent movement of the latch member 48 to an unlatched position and consequent unlatching of the door.

Pivotal movement of the handle from its latched to its unlatched position will of course have no effect on the latching member 48 if the lock mechanisms 44/46 are in a locked condition since in this situation the coupler 56 will act to decouple any movement of the rod 54 from the dog 52 and result in the handle simply freewheeling with no consequent unlatching of the door. However, the most typical operating mode of a moving vehicle involves unlocked doors and, in this most common scenario, side impact, if not guarded against in a manner such as in accordance with the present invention, can readily result in inertial movement of the handle to an unlatched position with consequent unlatching of the door. As noted however, this inadvertent unlatching movement of the handle and consequent unlatching of the door is effectively averted in the door handle assembly of the present invention by the positioning of the leading edge 32*d* of the stop portions 32*c* of the blocking member in the path of movement of the stop portions 30*d* of the handle to instantaneously interrupt any attempt on the part of the handle to move inertially to its unlatched position in response to an impact against the side of the vehicle.

Figure 4:
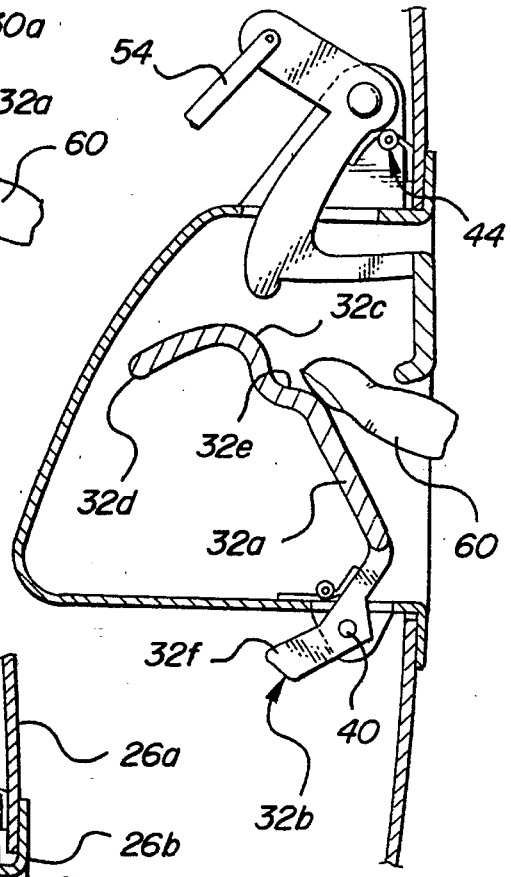
FIGS. 4 and 5, taken with FIG. 3, show the sequential operation of the invention door handle assembly.
Figure 5:
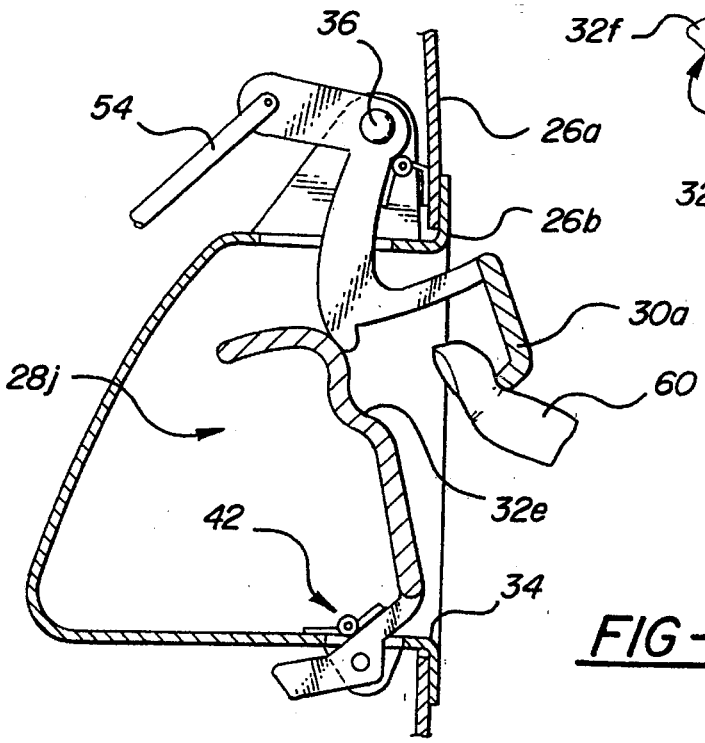
Figure 6:
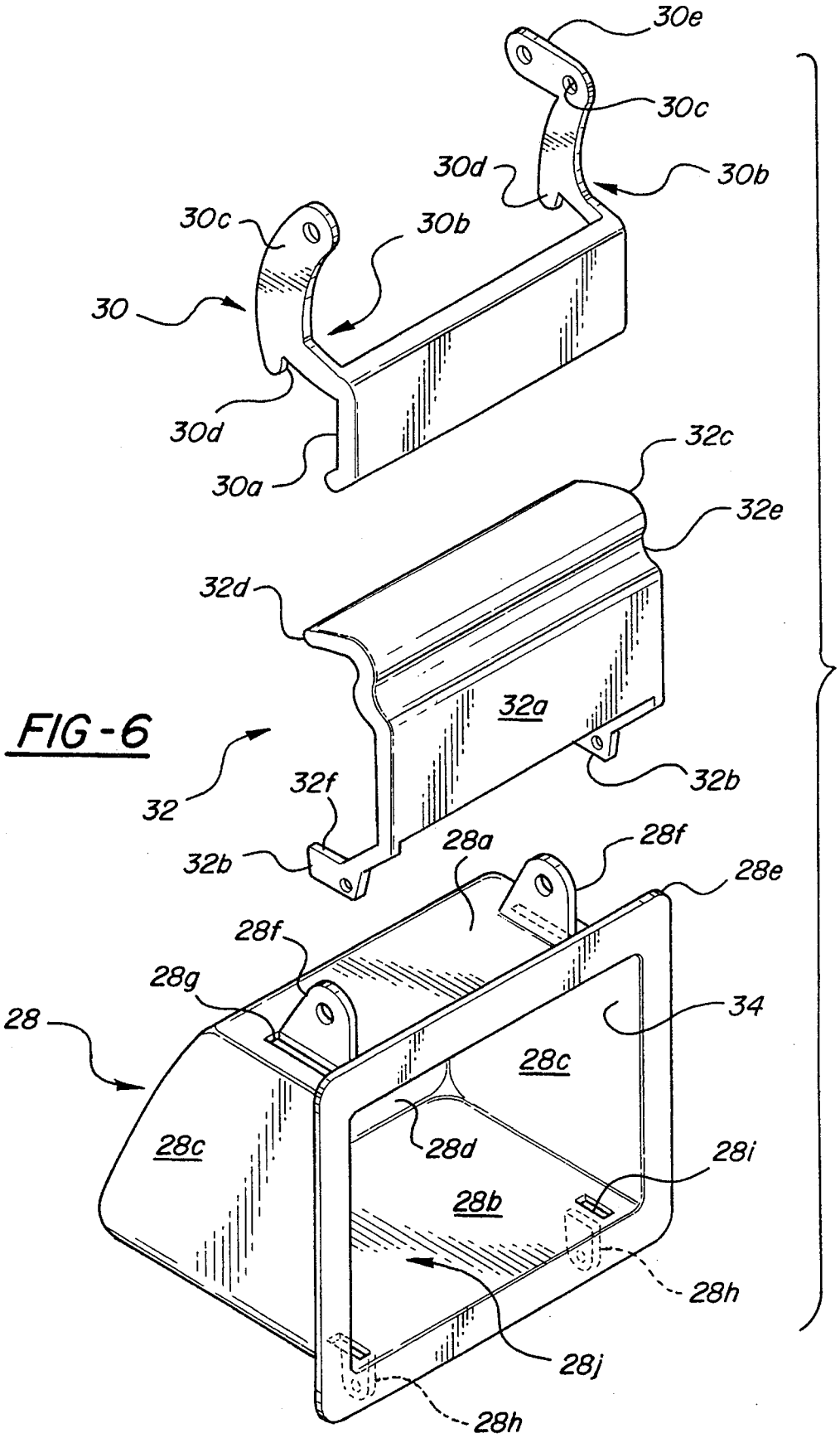
FIG. 6 is an exploded perspective view of the invention door handle assembly.

As best seen in FIGS. 4 and 5, the door handle may be deliberately moved to its unlatched position when so desired by a simple and facile cooperative movement of the blocking member and handle. Specifically, the handle may be moved to its unlatched position and the door opened by simply pressing the fingers 60 of an operator against the actuator portion 32*a* of the blocking member to pivot the blocking member about the axis of pin 40 and move the free end edge 32*d* of the stop portion 32*c* of the blocking member to a position out of the path of movement of the stop portions 30*d* of the pivot arms of the handle, whereafter the fingers 60 may be simply curled under the lower edge of the actuator portion 30*a* of the handle and the actuator portion pulled upon to pivot the handle about the axis of pin 36 to the position seen in FIG. 5 in which the dog 52 of the latch assembly 42 has been withdrawn to allow the latch member 48 to move to the solid line unlatching position of FIG. 6 to unlatch the door. In order to return the handle assembly to a latched condition, it is simply necessary to release the handle whereupon the handle and blocking member will return to the solid line positions of FIG. 3 under the influence of springs 42 and 44.

The invention door handle assembly will be seen to provide an effective means of precluding inadvertent unlatching of a vehicular door latch mechanism in the event of side impact while yet allowing the ready and facile operation of the release door assembly under normal operating conditions. The invention door handle assembly also provides an aesthetically pleasing appearance, is simple in construction and operation, and adapts readily to varied door configurations.

Whereas a preferred embodiment of the invention has been illustrated and described in detail it will be apparent that various changes may be made in the disclosed embodiment without departing from the scope or spirit of the invention.

I claim:

1. A door handle assembly for use with a vehicle including a door and a latch assembly mounted on the door and controlled by the door handle assembly, the door handle assembly including:

a housing adapted to be positioned in an outer skin of the door and defining a cavity and an opening into the cavity;

a handle having a lever configuration and including a pivot portion, a blade portion, and a stop portion between the pivot portion and the blade portion;

means mounting the pivot portion of the handle on an upper region of the housing for pivotal movement of the handle about a first axis between a latched position in which the blade portion is positioned in an upper region of the cavity opening and an unlatched position in which the handle is pivoted forwardly to position the blade portion forwardly of the cavity opening;

a blocking member having a lever configuration and including a pivot portion, a stop portion, and a blade portion between the pivot portion and the stop portion;

means mounting the pivot portion of the blocking member on a lower region of the housing for pivotal movement of the blocking member about a second axis between a blocking position, in which the blade portion is positioned in the cavity opening below the handle blade portion and the stop portion is positioned behind the blade portion of the handle in the path of movement of the handle stop portion, and a release position in which the blocking member is pivoted rearwardly within the cavity to move the blocking member stop portion out of the path of movement of the handle stop portion.

2. A handle assembly according to claim 1 wherein:

the housing has a top wall and a bottom wall;

the first pivot axis is located proximate the top wall of the housing; and the second pivot axis is located proximate the bottom wall of the housing.

3. A handle assembly according to claim 1 wherein:

the blocking member includes a horizontal outwardly opening groove between the blade portion and the stop portion;

the handle blade portion includes a free end edge portion extending rearwardly with respect to the main body of the handle blade portion; and with the handle in its latched position and the blocking member in its blocking position, the free end edge portion of the handle blade portion is seated in the groove of the blocking member.

4. A handle assembly according to claim 3 wherein the handle assembly further includes:

means biasing the handle toward its latched position and resiliently resisting movement of the handle toward its unlatched position; and means biasing the blocking member toward its blocking position and resiliently resisting movement of the blocking member toward its release position.

5. A door handle assembly for use with a vehicle including a door and a latch assembly mounted on the door and controlled by the door handle assembly, the door handle assembly comprising:

a housing adapted to be positioned in an outer skin of the door and defining a cavity and a window opening into the cavity;

a handle including an actuator portion and a stop portion;

means mounting the handle on the housing for movement between a latched position, in which the actuator portion is positioned in the window and the stop portion is positioned rearwardly of the actuator portion within the cavity, and an unlatched position in which the handle is moved forwardly to position the actuator portion forwardly of the window;

a blocking member; and means mounting the blocking member on the housing for pivotal movement about a pivot axis, the blocking member including a stop portion proximate an end of the blocking member remote from the pivot axis and an actuator portion between the stop portion and the pivot axis, the mounting means mounting the blocking member for movement between a blocking position, in which the blocking member actuator portion is positioned in the window proximate the handle actuator portion and the blocking member stop portion is positioned in the cavity in the path of movement of the handle stop portion, and a release position in which the blocking member is pivoted rearwardly to position the blocking member actuator portion within the cavity and move the blocking member stop portion out of the path of movement of the housing stop portion.

6. A door assembly for a motor vehicle including:

a door having an outer skin and a shut face;

a latch assembly positioned on the shut face of the door and including a latch member coacting with a bolt on the adjacent face of the vehicle body structure to latch the door to the vehicle body;

a handle adapted to be grasped by an operator, positioned proximate the outer skin of the door, and mounted for movement between a latched position and an unlatched position;

lock means mounted on the door for operator access and having an unlocked position in which movement of the handle to its unlatched position is effective to move the latch member to its latched position and a locked position in which movement of the handle to its unlatched position is ineffective to move the latch member to its unlatched position;

a blocking member; and means mounting the blocking member for movement by the operator, irrespective of the position of the lock means, between a blocking position in the path of movement of the door handle, whereby to preclude inadvertent movement of the door handle and thereby the latch member to an unlatched position with the lock means in an unlocked position, and a release position in which the blocking member is moved out of the path of movement of the door handle to allow advertent movement of the door handle and thereby the latch member to an unlatched position.

7. A door assembly according to claim 6 wherein:

the door assembly further includes a housing mounted in the outer skin of the door and defining a cavity in the door and an opening into the cavity; and the handle and the blocking member are mounted in the cavity for pivotal movement about parallel axes.

8. A door assembly according to claim 7 wherein:

the axes are generally horizontal;

the handle and blocking member include actuator portions with coact with the handle in its latched position and the blocking member in its blocking position to substantially close off the cavity opening.

9. A door assembly according to claim 8 wherein:

the handle actuator portion is positioned in an upper portion of the cavity opening; and the blocking member actuator portion is positioned in a lower portion of the cavity opening.

10. A door assembly according to claim 9 wherein:

the handle actuator portion pivots forwardly out of the cavity as the handle moves from its latched to its unlatched position; and the blocking member actuator portion pivots rearwardly into the cavity as the blocking member moves from its blocking to its release position whereby the operator may push the blocking member actuator portion rearwardly into the cavity to release the door handle and may thereafter pull the door handle actuator portion forwardly to unlatch the door.

11. A door handle assembly for use with a vehicle including a door and a latch assembly mounted on the door and controlled by the door handle assembly, the door handle assembly including:

a door handle adapted to be grasped by an operator and including a stop portion;

means mounting the door handle proximate an exterior surface of the door for movement between a latched position in which the latch assembly maintains the door in a latched condition and an unlatched position in which the latch assembly is moved to an unlatched condition;

means biasing the handle toward its latched position and resiliently resisting movement of the handle toward its unlatched position;

a blocking member including a stop portion;

means mounting the blocking member proximate the door handle for movement under control of the operator between a blocking position in which the blocking member stop portion is positioned in the path of movement of the door handle stop portion to preclude movement of the door handle to its unlatched position and a release position in which the blocking member stop portion is moved out of the path of movement of the door handle stop portion to allow movement of the door handle to its unlatched position;

the door handle having a lever configuration and being mounted for pivotal movement about a first axis between its latched and unlatched position;

the blocking member having a lever configuration and being mounted for pivotal movement about a second axis spaced from and immoveable with respect to the first axis;

the handle assembly further including a housing;

the first and second axes being defined on the housing;

a free end portion of the blocking member constituting the stop portion of the blocking member; and with the door handle in its latched position and the blocking member in its blocking position, a free end portion of the door handle being positioned proximate an intermediate portion of the blocking member and the free end portion of the blocking member being positioned proximate the stop portion of the door handle.

12. A door handle assembly according to claim 11 wherein:

the handle includes an actuator portion including the handle free end; and the stop portion of the handle is defined between the first axis and the actuator portion.

13. A door handle assembly for use with a vehicle including a door and a latch assembly mounted on the door and controlled by the door handle assembly, the door handle assembly comprising:

a housing adapted to be positioned in an outer skin of the door and defining a cavity and a window opening into the cavity;

a handle including an actuator portion and a stop portion;

means mounting the handle on the housing for movement between a latched position, in which the actuator portion is positioned in the window and the stop portion is positioned rearwardly of the actuator portion within the cavity, and an unlatched position in which the handle is moved forwardly to position the actuator portion forwardly of the window;

a blocking member including an actuator portion and a stop portion;

means mounting the blocking member on the housing for movement between a blocking position, in which the blocking member actuator portion is positioned in the window proximate the handle actuator portion and the blocking member stop portion is positioned in the cavity in the path of movement of the handle stop portion, and a release position in which the blocking member is moved rearwardly to position the blocking member actuator portion within the cavity and move the blocking member stop portion out of the path of movement of the housing stop portion;

the housing including a top wall and a bottom wall;

the handle being pivotally mounted proximate the top wall of the housing for pivotal movement about a generally horizontal axis;

the handle actuator portion, with the handle in its latched position, being positioned in an upper region of the window;

the blocking member being pivotally mounted proximate the bottom wall of the housing for pivotal movement about a generally horizontal axis; and with the blocking member in its blocking position, the blocking member actuator portion being positioned in a lower region of the window beneath the handle actuator portion and the blocking member stop portion being positioned behind the handle actuator portion in confronting relation to the handle stop portion.

* * * * *